US010119676B2

(12) United States Patent
Schiccheri et al.

(10) Patent No.: US 10,119,676 B2
(45) Date of Patent: Nov. 6, 2018

(54) LIGHTING DEVICE, CORRESPONDING LAMP AND METHOD

(71) Applicant: OSRAM GmbH, Munich (DE)

(72) Inventors: Nicola Schiccheri, Padua (IT); Alessandro Bizzotto, Castelfranco Veneto (IT); Marco Munarin, Paese (IT)

(73) Assignee: OSRAM GMBH, Munich (DE)

( * ) Notice: Subject to any disclaimer, the term of this patent is extended or adjusted under 35 U.S.C. 154(b) by 13 days.

(21) Appl. No.: 15/250,988

(22) Filed: Aug. 30, 2016

(65) Prior Publication Data

US 2017/0356616 A1 Dec. 14, 2017

(30) Foreign Application Priority Data

Jun. 10, 2016 (IT) ..... 102016000059954

(51) Int. Cl.
*F21V 7/00* (2006.01)
*F21S 8/10* (2006.01)
(Continued)

(52) U.S. Cl.
CPC ..... *F21S 48/1317* (2013.01); *F21K 9/61* (2016.08); *F21S 41/143* (2018.01); *F21S 41/24* (2018.01);
(Continued)

(58) Field of Classification Search
CPC ..... F21S 48/1317; F21S 48/1154; F21S 48/1329; F21V 7/0008; F21V 7/0091; F21V 9/08; F21Y 2115/10
(Continued)

(56) References Cited

U.S. PATENT DOCUMENTS 6,724,543 B1 * 4/2004 Chinniah ..... F21S 48/2212 359/718
8,616,733 B1 * 12/2013 Millikan ..... F21V 5/04 362/249.02
(Continued)

FOREIGN PATENT DOCUMENTS

WO 2010144572 A2 12/2010

OTHER PUBLICATIONS

Italian Search Report based on application No. 102016000059954 (8 pages) dated Nov. 28, 2016.

*Primary Examiner* — Anh Mai
*Assistant Examiner* — Jessica M Apenteng
(74) *Attorney, Agent, or Firm* — Viering, Jentschura & Partner MBB

(57) ABSTRACT

A lighting device, which may be used e.g. to produce motor vehicle lamps, may include a light radiation source, e.g. a LED source, having a light-permeable body arranged facing source for propagating light radiation along a longitudinal axis. The light-permeable body includes a collimator exposed to light radiation source and adapted to collect light radiation and to inject it into light-permeable body, a tapered portion coupled to collimator for receiving light radiation and directing it towards an output end, a distal portion acting as an emission filament, coupled to the output end of tapered portion, with an output mirror having a shank portion extending in said distal portion and a head portion, the output mirror reflecting light radiation radially from longitudinal axis and proximally towards said light radiation source.

9 Claims, 4 Drawing Sheets

(51) Int. Cl.

| | |
|---|---|
| ***F21V 9/08*** | (2018.01) |
| ***F21V 5/04*** | (2006.01) |
| ***F21V 7/04*** | (2006.01) |
| ***F21K 9/61*** | (2016.01) |
| ***F21S 41/143*** | (2018.01) |
| ***F21S 41/24*** | (2018.01) |
| ***F21S 41/32*** | (2018.01) |
| *F21Y 115/10* | (2016.01) |

(52) U.S. Cl.
CPC ..... *F21S 41/32* (2018.01); *F21S 41/322* (2018.01); *F21V 5/04* (2013.01); *F21V 7/0008* (2013.01); *F21V 7/0033* (2013.01); *F21V 7/0091* (2013.01); *F21V 7/041* (2013.01); *F21V 9/08* (2013.01); *F21Y 2115/10* (2016.08)

(58) Field of Classification Search
USPC ..... 362/307
See application file for complete search history.

(56) References Cited

U.S. PATENT DOCUMENTS

| | | | | |
|---|---|---|---|---|
| 2008/0142816 | A1* | 6/2008 | Bierhuizen | F21K 9/00 257/82 |
| 2008/0192457 | A1* | 8/2008 | Krijn | G02B 6/002 362/19 |
| 2009/0225529 | A1 | 9/2009 | Falicoff et al. | |
| 2010/0208488 | A1 | 8/2010 | Luo | |
| 2014/0211481 | A1 | 7/2014 | Liang et al. | |

* cited by examiner

LIGHTING DEVICE, CORRESPONDING LAMP AND METHOD

CROSS-REFERENCE TO RELATED APPLICATION

This application claims priority to Italian Patent Application Serial No. 102016000059954, which was filed Jun. 10, 2016, and is incorporated herein by reference in its entirety.

TECHNICAL FIELD

Various embodiments generally relate generally to lighting devices.

One or more embodiments may refer to lighting devices including electrically-powered light radiation sources, e.g. solid-state sources, such as LED sources, adapted to be employed in sectors such as the automotive sector.

BACKGROUND

Solid State Lighting (SSL) technology has recently been increasingly used in various fields of lighting, such as general lighting, entertainment and automotive lighting.

The latter applications may be generally divided into two broad categories: exterior lighting (outer front and rear lamps of the vehicle) and interior lighting (interior ambient, reading and instrument cluster lighting).

One or more embodiments may mainly refer to the possible application in the automotive field, e.g. in lighting devices adapted to be used for the so-called "retrofit" in vehicle headlamps.

International regulations concerning vehicle headlamps define for example that, e.g. for a front headlamp application, the following functions may be included: high and low beam, Daytime Running Light (DRL), front position, turn indicator and front fog lamps.

In order to be homologated and installed in a vehicle, each function must achieve certain photometrical values as defined in the regulations. This means, for example, that a lamp may be required to generate a light beam which is shaped so that the luminous intensity falls within a range of minimum and maximum values in some angular points.

For example, the functions of high and low beam or the fog lamp function may require a higher luminous intensity than other functions, and therefore may require sources with high flux.

For such applications so-called H-type lamps or bulbs may be used, the most common types belonging to the categories H7, H8, H10, H11 and H16, as defined by UNECE Regulations.

In a conventional arrangement, the optical system may comprise an incandescent light source that generates the light radiation, a reflector adapted to collect light radiation in order to project it forwards and a lens.

The optical system may be designed while taking into account the geometric features of the lamp or bulb, such as the position and the size of the filament, the emission pattern of the light coming from the bulb and the total luminous flux emitted.

Various efforts have recently focused on the production of H-type bulbs by resorting to a LED technology, which may be used to replace the traditional incandescent bulbs.

The most challenging task is probably the development of a LED device adapted to replace an incandescent lamp of the front headlamps, while complying with the photometrical requirements provided by the regulations, i.e. a LED device having a light emitting volume, a radiation pattern and a total flux which are similar to an incandescent device.

In this respect, a factor which must be taken into account is given by the difference of the light emission in an incandescent filament and in a LED.

An incandescent filament emits the light radiation in a substantially anisotropic pattern around the filament axis.

On the contrary, a LED emits light from a solid-state chip towards a half-space (hemisphere) according to a pattern which may be a lambertian pattern.

A possible solution is the symmetrical arrangement of the LEDs around what may be considered as the axis of a traditional filament.

This solution has however various drawbacks in its application.

For example, the emitting volume may be definitely higher than the emitting volume of the filament. This may lead to having a light emission in areas which are out of the focus of the reflector: in applications such as high/low lamps, it may then be difficult to meet certain requirements due to the need of avoiding glaring above a certain horizontal line.

WO 2006/054199 A1 describes a light guide coupled to an SSL source, for driving the light towards an out-coupling structure. The size and position of the out-coupling structure may be chosen so as to be similar to the size and position of the filament of a traditional bulb. This out-coupling structure may include a rough surface, cuts or notches on the surface of a glass fibre.

JP 2011/023299 A shows a LED facing an optical system adapted to diffuse light. The optical system may be refractive, and some surfaces may deviate the direction of the light rays by employing reflective surfaces.

WO 2013/071972 A1 regards a solution wherein LED light radiation sources are arranged in the area which is supposed to host the filament of a traditional bulb, but without resorting to refractive or reflective optical systems.

Despite the intensive development activity, the evidence whereof is provided by the above documents, the need is still felt of solutions adapted to overcome the previously outlined drawbacks.

SUMMARY

One or more embodiments aim at overcoming the previously outlined drawbacks.

According to one or more embodiments, said object may be achieved thanks to a lighting device having the features set forth in the claims that follow.

One or more embodiments may also concern a corresponding lamp, i.e. the assembly of the lighting device and of a casing wherein the former is inserted (e.g. associated with a reflector and/or a lens) as well as a corresponding method.

One or more embodiments lead to the implementation of a lighting device adapted to reproduce the light emission features of a H-type bulb (e.g. H11) by resorting to the solid-state, e.g. LED, technology.

However, one or more embodiments are not limited to the implementation of H11 devices; as a matter of fact, by adapting the size and the output flux, one or more embodiments may involve H-type bulbs of a different kind.

One or more embodiments may offer one or more of the following advantages:

possibility of achieving a light emission similar to an incandescent filament bulb with a solid-state lighting device, e.g. a LED lighting device, the option being given to have a light output volume similar to the light output volume of a filament lamp, high total efficiency of the system, thanks to a light radiation collecting system employing a lens, arrangement of the light radiation source away from the volume of light radiation emission, which facilitates the thermal management of the lighting device.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

Figure 1:
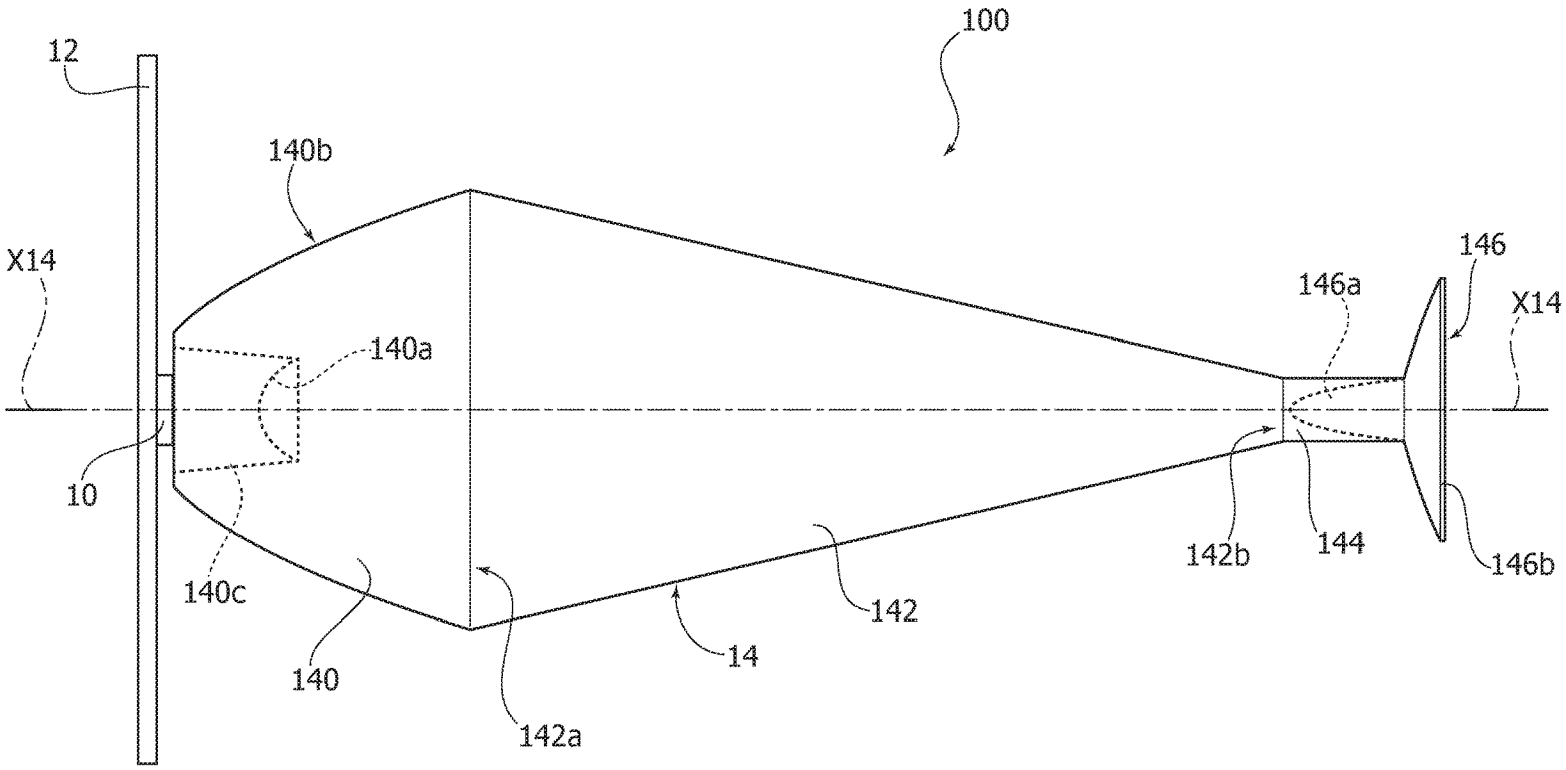
FIG. 1 shows a lighting device according to one or more embodiments, shown in a side view.

In the following description, various specific details are given to provide a thorough understanding of various exemplary embodiments of the present description. The embodiments may be practiced without one or more of the specific details, or with other methods, components, materials, etc. In other instances, well-known structures, materials, or operations are not shown or described in detail to avoid obscuring various aspects of the embodiments.

Reference throughout this specification to "one embodiment" or "an embodiment" means that a particular feature, structure, or characteristic described in connection with the embodiment is included in at least one embodiment. Thus, the possible appearances of the phrases "in one embodiment" or "in an embodiment" in various places throughout this specification are not necessarily all referring to the same embodiment. Furthermore, particular features, structures, or characteristics may be combined in any suitable manner in one or more embodiments.

The headings provided herein are for convenience only, and therefore do not interpret the extent of protection or the scope of the embodiments.

One or more embodiments may refer to a lighting device 100 employing solid-state light radiation sources, adapted to reproduce the radiation pattern of an incandescent bulb lighting device, e.g. a halogen lighting device, of the kind used for example to produce vehicle lamps.

One or more embodiments may employ, as an electrically-powered light radiation source, a solid-state light radiation source such as a LED source 10.

In one or more embodiments, source 10 may be arranged on a substrate or support 12 which is substantially similar e.g. to a Printed Circuit Board (PCB).

In one or more embodiments, LED source 10 may include one single chip per package or a multichip source, including several LED chips per package: for example, in one or more embodiments source 10 may include a plurality of LED sources, arranged and configured in such a way as to increase the total output flux.

In one or more embodiments, source 10 may consist of a so-called Chip Scale Package (CSP).

Generally speaking, but without limiting the embodiments, source 10 may be assumed as emitting the light radiation according to a lambertian pattern in the half-space demarcated by the plane of substrate or support 12 (on the right, according to the viewpoint of the Figures).

In one or more embodiments, source 10 may be associated with a body of a light-permeable material, denoted on the whole as 14.

In one or more embodiments, body 14 may be comprised of a transparent thermoplastic material, glass or silicone.

In one or more embodiments, body 14 may include a plurality of portions (discussed in the following) which are either made of one piece or distinct and connected with one another.

In one or more embodiments, body 14 may extend along a longitudinal axis X14, and may be arranged in a position facing light radiation source 10, so as to propagate the light radiation emitted by source 10 distally (i.e. away from source 10, towards the right with reference to the viewpoint of the annexed Figures) along said longitudinal axis X14.

In one or more embodiments, body 14 may include a first portion 140 including a Total Internal Reflection (TIR) collimator, which in turn is adapted to include a lenticular surface 140*a* exposed to light radiation source 10.

The light radiation emitted by light radiation source 10 within a solid angle $\alpha$ (alpha)—which is assumed to correspond to a cone the vertex whereof is located in surface 10—may therefore be collected by lenticular surface 140*a* and be injected into light-permeable body 14.

In one or more embodiments, collimator portion 140 may include an outer surface 140*b* arranged around lenticular surface 140*a* in such a way that the light radiation emitted by light radiation source 10 outside said solid angle is adapted to impinge on said outer surface 140*b* and to be reflected inside light-permeable body 14.

In one or more embodiments, lenticular surface 140*a* may form the bottom portion of a cup-shaped cavity, which is located in the proximal end of collimator 140 and has a lateral surface 140*c* which may have the shape of a cylinder or a truncated cone (tapered towards lenticular surface 140*a*).

In one or more embodiments, lenticular surface 140*a* may be shaped as a spherical or aspherical lens, or as a lens which may be defined, with a phrase taken from the field of corrective lenses, as a free-form lens.

One or more embodiments may include, located downstream collimator 140, a further portion of body 14, denoted as 142, of a generally tapered shape (e.g. a truncated cone) having a wider input end 142*a*, facing collimator 140, and a narrower output end 142*b*, opposed to collimator 140.

The terms "larger" and "narrower" are of course to be understood in a relative sense, indicating that part 142 increasingly narrows from input end 142*a* (which is "wider" than output end 142*b*) towards output end 142*b* (which is "narrower" than output end 142*a*).

In one or more embodiments, input end 142 may be coupled to collimator 140 (e.g. being formed in one piece with the latter) so that it collects the light radiation collimated thereby and directs it towards output end 142*b*.

In one or more embodiments, body 14 may include, being coupled (e.g. in a single piece) to the narrower end 142*a* of tapered portion 142, a distal portion 144 which may be defined as a filament portion, with reference to the function thereof which will be discussed in the following.

In one or more embodiments, distal portion 144 may have e.g. the shape of a cylinder or of a truncated cone.

In one or more embodiment, the assembly of portion 140 and of portion 142 of body 14 may receive the light radiation emitted by source 10, while focusing it into distal portion 144.

In one or more embodiments, this may take place thanks to various mechanisms.

Figure 2:
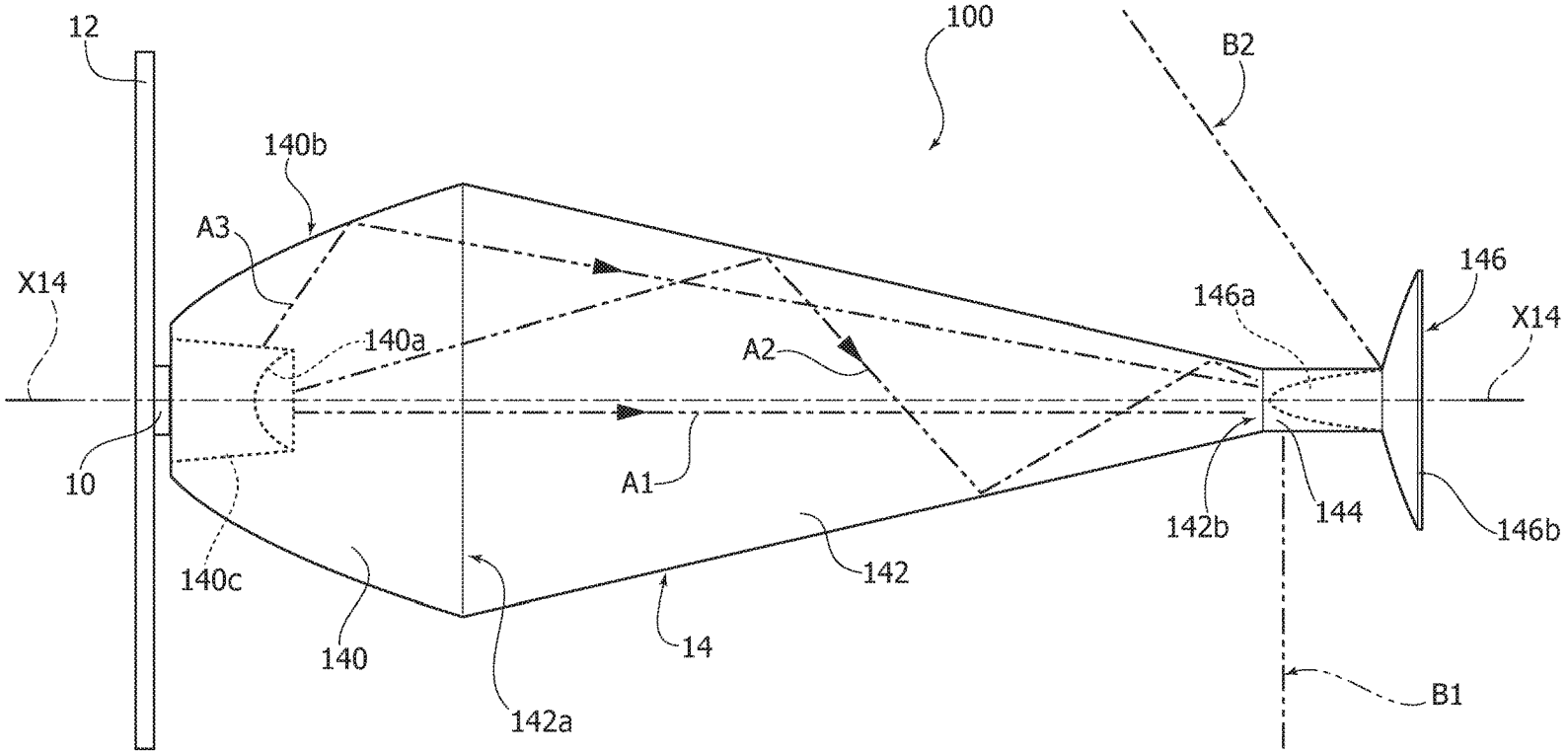
FIG. 2 shows in longitudinal section a lighting device according to one or more embodiments, while highlighting some possible paths of the light rays.

For example, the light radiation emitted by source 10 within solid angle α (the width whereof may be defined as a function of the focal length and of the lateral dimension of lenticular surface 140*a*) may be "captured" by lenticular surface 140*a* itself, and may be injected into portion 142 at such an angle as to be sent back directly towards portion 144 (see e.g. the path exemplified and denoted as A1 in FIG. 2).

Again by way of example, the radiation emitted by source 10 outside solid angle α may traverse surface 140*c* and impinge on lateral surface 140*b* itself, so as to be reflected thereby towards portion 144 (see e.g. the path exemplified and denoted as A2 in FIG. 2).

Again by way of example, the light radiation emitted by source 10 within solid angle α may be captured by lenticular surface 140*a* and may be injected into portion 142 at such an angle as to converge onto portion 144 after being reflected, once or several times, on lateral wall of portion 142, which therefore acts as a wave guide (see e.g. the path exemplified and denoted as A3 in FIG. 2).

A similar (optionally plural) reflection mechanism on lateral wall of portion 142 may lead to the convergence into portion 144 of the light radiation emitted by source 10 outside solid angle α.

In one or more embodiments, one or more of the various surfaces involved in this mechanism adapted to capture the radiation of source 10 and converge it into portion 144 (e.g. one or more of the surfaces 140*a*, 140*b*, 140*c* and the surface of body 142) may include surfaces of revolution (or, more precisely, surfaces with cylindrical symmetry) around axis X14. For example, in one or more embodiments, surface 140*b* may be a parabolic, quasi-parabolic or complex surface.

In one or more embodiments, portion 140 acting as a collimator may therefore be coupled (optionally by being formed in one piece) to tapered portion 142, thereby forming a sort of converging wave guide adapted to collect the light radiation injected therein by collimator portion 140, in such a way as to focus it, thanks to the features of total internal reflection, towards the narrower end 142*b* and therefore towards distal portion 144.

In one or more embodiments, the size of portion 144 may be reduced on the whole, so that it is similar to the size of an incandescent filament.

This choice is however by no way compulsory, because the radial dimensions of distal portion 144 may be either larger or smaller that the dimensions of a filament.

In any case, portion 144 is adapted to collect (virtually all) the radiation emitted by source 10, focused thereon by collimator 140 and by the converging wave guide 142, so as to act as a "filament" for light radiation emission from device 100.

In one or more embodiments it is therefore possible to choose the shape and/or the size of portion 144 in such a way as to comply with the features (e.g. photometric values, non-glaring properties and others) defined by lighting regulations, e.g. in the automotive sector.

In one or more embodiments, device 100 may include an output mirror 146 having a generally mushroom shape (i.e. a T-shape) and including in turn a shank portion 146*a*, which e.g. may be tapered, which extends in the distal filament-like portion 144 of body 14, and a head portion 146*b*, again radially tapered.

In one or more embodiments, the achievement of a light distribution similar to a traditional incandescent filament may be facilitated by the (three-dimensional) mirror 146 inserted into portion 144.

In one or more embodiments, the mushroom-like shape of mirror 146 (a shape that grossly resembles a push-pin) may be obtained in one piece or in several parts, e.g. depending on different operational needs. For example, in one or more embodiments as discussed in the following, mirror 146 may be implemented with the features of a dichroic filter.

In one or more embodiments, the shank portion 146*a* of mirror 146 may be inserted, either completely or only partially, into portion 144, also depending on the needs of anisotropic light emission around axis X14.

In one or more embodiments, head portion 146*b* may be located outside body 14, so as to be adapted to perform a front masking function of the light radiation source (anti-glare function), while being also adapted to perform a backward reflective function towards light radiation source 10, according to ways substantially similar to those which regulate the emission of the light radiation source from an incandescent filament of a traditional bulb.

In one or more embodiments, the shank portion 146*a* and/or the head portion 146*b* may have symmetry of revolution (more precisely, cylindrical symmetry) around axis X14.

For example, in one or more embodiments it is possible to resort to a e.g. conic shape, which may be complex with a polynomial pattern, a so-called Bézier curve or a free form, such as a spline.

Figure 3:
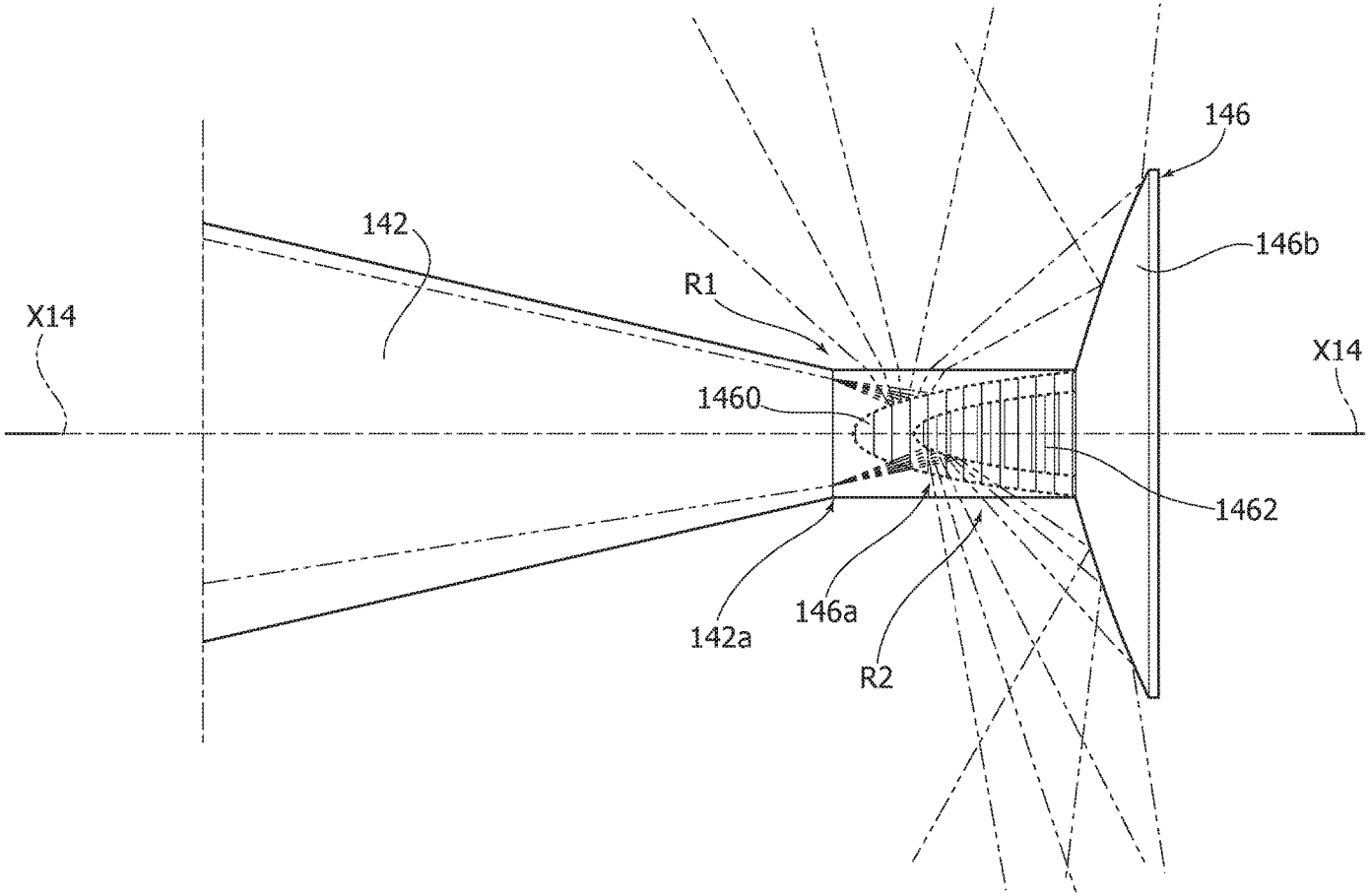
FIG. 3 shows in greater detail possible implementation and operational features of a part of a device as exemplified in FIGS. 1 and 2.

In one or more embodiments:

shank portion 146*a* (which may be e.g. tapered) may extend in the distal portion (filament) 144 of body 14 in such a way as to reflect the light radiation focused in said portion 144 in a radial direction, towards the outside of longitudinal axis X14 (see for example the ray path denoted as B1 in FIG. 3), and head portion 146*b* may reflect the light radiation focused in portion 144 in the proximal direction, i.e. backwards towards light radiation source 10 (see e.g. the ray path denoted as B2 in FIG. 3).

In one or more embodiments, mirror 146 may have reflective features both of a specular and of a diffusive kind.

For example, in one or more embodiments, a coating of a material bringing about such features may be applied onto the surfaces of mirror 146.

For example, in one or more embodiments, the features of specular reflectance may be obtained by depositing a coating, e.g. of aluminium or silver, and/or the features of diffusive reflectance may be obtained by employing light-coloured materials (e.g. white materials) or materials having a surface graining.

In one or more embodiments, both portions 146*a* and 146*b* of mirror 146 may have identical optical characteristics.

In one or more embodiments, portions 146*a* and 146*b* of mirror 146 may have different features.

In one or more embodiments, mirror 146 may be formed in one piece or in several pieces having different optical characteristics.

For example, in one or more embodiments, shank portion 146*a* may be formed of a white material, having on some portions a coating formed by specularly reflective strips.

The presently exemplified optical system (portions 140, 142, 144, mirror 146) may be implemented with materials such as thermoplastic materials, glass or silicone.

In one or more embodiments, the light radiation emitted from the device may have an overall cylindrical shape.

In one or more embodiments different emission patterns may be implemented, e.g. in the shape of a truncated cone.

In one or more embodiments as exemplified herein, distal portion 144 may have a cylindrical shape. In one or more embodiments, it may have a different shape, e.g. the shape of a truncated cone.

In one or more embodiments, portion 144 may include a transparent material.

In one or more embodiments, portion 144 may include a material embedding scattering particles (e.g. alumina particles) and/or phosphors embedded in the bulk material.

In one or more embodiments, portion 144 may have transparent surfaces.

In one or more embodiments, portion 144 may have smooth surfaces.

In one or more embodiments, portion 144 may have sculptured surfaces, e.g. having prism-shaped ribs, cylindrical strips or bumps.

In one or more embodiments, portion 144 may be totally or partially coated by or provided with a surface graining.

One or more embodiments may take advantage of the fact that the white light radiation emitted by a solid-state light radiation source 10, such as a LED source, may have a rather narrow and clearly defined peak in the blue region and a broader bell curve in the yellow emission region.

The blue emission peak may be located around 440 nm, the other emission having a peak around 550 nm.

The blue and yellow emissions are joined at around 500 nm at a spectral "hole" or well.

The "white" light radiation emitted by a source such as a LED source may therefore be considered as formed by the overlap of two emission beams, one in the blue region and the other in the yellow region.

These beams may be separated with relative ease, e.g. through a dichroic filter with a cut-off around 500 nm.

In this way it is possible to use two beams of high spectral purity, with the possibility of managing them in different ways in the optical system.

For example, in one or more embodiments, the three-dimensional mirror 146 (e.g. shank portion 146*a*) may have a multi-layered structure, e.g. with two materials 1460, 1462 adapted to be over-molded.

For example, in one or more embodiments, on the surface of the "more external" material 1460, on which the light radiation impinges, there may be provided a coating of a (known) dichroic film, adapted to reflect light in the blue region and to be permeated by the light in the yellow region.

In this way, as exemplified at R1 in FIG. 3, the light in the blue region may be reflected and projected outwards ("extracted") from the optical system, the direction of the rays depending on the shape of the outer surface of mirror 146 according to the law of reflection.

The radiation in the yellow region, transmitted across the dichroic filter, may enter material 1460 carrying the dichroic layer, the propagating direction being tilted according to Snell's law. The radiation in the yellow region may propagate within material 1460 as far as the interface with the second material 1462. This surface may have a specular reflectance, which may be obtained e.g. by depositing a reflective coating, or a diffusive reflectance if the second material is white, so as to obtain a lambertian reflectance.

At said interface, the direction of the rays in the yellow region may be determined according to the law of reflection, the possibility being given to modify the direction of the reflected yellow beam by choosing the surface structure.

The reflected rays in the yellow region travel through the first material as far as the first dichroic filter, they go through it and are reflected and projected outwards ("extracted") from the optical system, as exemplified at R2 in FIG. 3.

The radiation beams in the blue and in the yellow region may therefore be directed in different directions, by variously designing the surface on which the dichroic filter is deposited and the surface on which the beam transmitted by the dichroic filter is reflected.

One or more embodiments enable therefore the presence of two beams, e.g. in the blue and in the yellow regions, which are emitted by the same source but with different directions and angular distributions (see e.g. R1 and R2 in FIG. 3).

FIG. 3 also shows that, even irrespective of the presence of a differentiated reflection mechanism for different wavelengths/bands:

the light reflection in the proximal direction towards light radiation source 10 may also derive from a double reflection, on the shank portion 146*a* and then on head portion 146*b* of the three-dimensional mirror 146, and/or an optional (e.g. second) reflection on head portion 146*b* of the three-dimensional mirror 146 may also bring about a radial reflection of the light, or a reflection in the distal direction away from light radiation source 10.

In one or more embodiments, therefore, the secondary optics of device 100 may be implemented in such a way as to reproduce the beam emission patterns that are currently used in the automotive sector, by directing the beams in the blue and in the yellow regions to different areas.

For example, the beam in the blue region may be projected mainly to the ground, while the yellow beam may be projected mainly on the area of horizontal cut-off. In this way the glaring effect, which may be annoying for the drivers coming from the opposite direction, may be reduced and virtually eliminated.

In one or more embodiments, the differentiated reflection mechanism based on a spectral filtering (e.g. via a dichroic filter) may be applied to emission wavelengths/bands other than blue or yellow, which have been previously discussed by way of example only.

Figure 4:
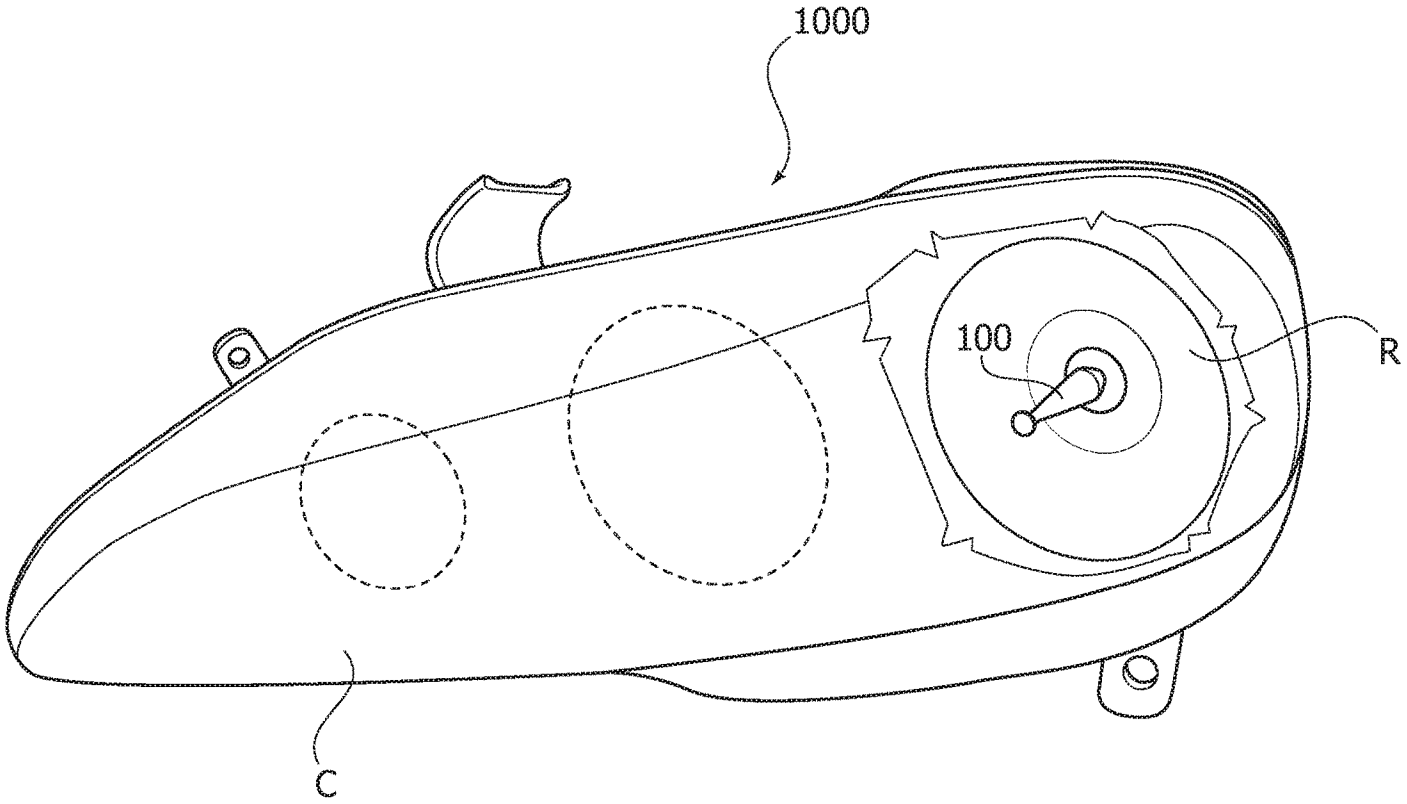
FIG. 4 shows an example of a vehicle lamp adapted to include a device as exemplified in FIGS. 1 and 2.

FIG. 4 exemplifies the possibility of using a lighting device 100 according to one or more embodiments, in order to implement a lamp 1000 for a vehicle (e.g. a front headlamp for a car).

Said lamp 1000 may include, in a way known in itself, a housing casing C wherein one or more lighting devices 100 may be mounted, e.g. by plugging them into a corresponding reflector R, the casing including at least a light-permeable portion (e.g. a transparent, optionally lens-shaped portion) for emitting the light radiation coming from source 10 of lighting device 100.

One or more embodiments may therefore concern a lighting device (e.g. 100) including:

an electrically-powered solid-state light radiation source (e.g. 10), a light-permeable body (e.g. 14) having a longitudinal axis (e.g. X14) arranged facing said light radiation source, for propagating light radiation from said source distally of the light radiation source, along said longitudinal axis, the light-permeable body including:

i) a collimator (140) exposed to said light radiation source and adapted to collect light radiation from said light radiation source and to inject it into said light-permeable body, ii) a portion (e.g. 142) tapered from an input end (e.g. 142*a*) towards an output end (e.g. 142*b*), the input end of said tapered portion being coupled to said collimator for receiving light radiation collimated thereby and directing said collimated radiation towards said output end, iii) a distal portion (e.g. 144) coupled to the output end of said tapered portion, the device including an output mirror (e.g. 146) with an optionally tapered shank portion (e.g. 146*a*) extending in said distal portion, and a head portion (e.g. 146*b*) for reflecting light radiation radially (e.g. B1) from said longitudinal axis, and/or proximally (e.g. B2) towards said light radiation source.

In one or more embodiments, said collimator may include:

a lenticular surface (e.g. 140*a*) exposed to said light radiation source, for collecting light radiation emitted by said light radiation source within a certain solid angle (e.g. $\alpha$), and an outer surface (e.g. 140*b*) around said lenticular surface for reflecting light radiation emitted by said light radiation source outside said solid angle.

In one or more embodiments, said collimator may include a proximal cavity facing said light radiation source, said cavity having a peripheral wall (e.g. 140*c*) surrounding a bottom wall, said bottom surface including said lenticular surface.

In one or more embodiments, said collimator and/or said tapered portion and/or said distal portion may have symmetry of revolution (cylindrical symmetry) around said longitudinal axis.

In one or more embodiments, said distal portion may be filament-like.

In one or more embodiments, said output mirror may be specularly reflective, and/or diffusively reflective and/or partly specularly reflective and partly diffusively reflective.

In one or more embodiments, said output mirror may have a layered dichroic filter structure (e.g. 1460, 1462).

In one or more embodiments, said output mirror may include a first and a second layer, said first layer having a dichroic filtering surface, so that light radiation is partially reflected (e.g. R1) on said first surface and partially propagates through said first layer towards said second layer, to be reflected (e.g. R2) from said second layer.

In one or more embodiments, said light radiation source may include a LED source.

In one or more embodiments, a lamp (e.g. 1000), e.g. for (motor) vehicles, may include:

a lighting device according to one or more embodiments, and a casing (C) for housing said lighting device, said casing including at least one light-permeable portion for emitting light radiation coming from said lighting device.

In one or more embodiments, a method of providing a lighting device may include:

providing an electrically-powered solid-state light radiation source, arranging facing said light radiation source a light-permeable body having a longitudinal axis for propagating light radiation from said source distally of the light radiation source along said longitudinal axis, the light-permeable body including:

i) a collimator exposed to said light radiation source and adapted to collect light radiation from said light radiation source and to inject it into said light-permeable body, ii) a portion which is tapered from an input end towards an output end, the input end of said tapered portion being coupled to said collimator for receiving light radiation collimated thereby and directing said collimated radiation towards said output end, iii) a distal portion coupled to the output end of said tapered portion, providing an output mirror with a shank portion extending in said distal portion and a head portion for reflecting light radiation radially from said longitudinal axis and/or proximally towards said light radiation source.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A lighting device, comprising:

an electrically-powered light radiation source, a light-permeable body having a longitudinal axis arranged facing said light radiation source for propagating light radiation from said source distally of the light radiation source along said longitudinal axis, the light-permeable body comprising:

a collimator exposed to said light radiation source for collecting light radiation from said light radiation source and injecting it into said light-permeable body, a portion tapered from an input end towards an output end, the input end of said tapered portion coupled to said collimator for receiving light radiation collimated thereby and directing said collimated radiation towards said output end, and a distal portion coupled to the output end of said tapered portion, the device further comprising an output mirror with a shank portion extending in said distal portion and a head portion, said output mirror reflecting light radiation radially from said longitudinal axis and proximally towards said light radiation source;

wherein the shank portion extending in the distal portion of said output mirror has a layered dichroic filter structure;

wherein said layered dichroic filter structure includes a first and a second layer, said first layer having a dichroic filtering surface, wherein light radiation is partially reflected from said first surface and partially propagates through said first layer towards said second layer to be reflected from said second layer.

2. The lighting device of claim 1, wherein said collimator comprises:

a lenticular surface exposed to said light radiation source to collect light radiation emitted by said light radiation source within a certain solid angle, and an outer surface around said lenticular surface to reflect light radiation emitted by said light radiation source outside said solid angle.

3. The lighting device of claim 2, wherein said collimator includes a proximal cavity facing said light radiation source, said cavity having a peripheral wall surrounding a bottom wall, said bottom surface including said lenticular surface.

4. The lighting device of claim 1, wherein said collimator and/or said tapered portion and/or said distal portion have symmetry of revolution around said longitudinal axis.

5. The lighting device of claim 1, wherein said distal portion is filament-like.

6. The lighting device of claim 1, wherein said output mirror, is specularly reflective and/or is diffusively reflective and/or is partly specularly reflective and partly diffusively reflective.

7. The lighting device of claim 1, wherein said light radiation source includes a LED source.

8. A lamp comprising:

a lighting device, said lighting device, comprising:

an electrically-powered light radiation source, a light-permeable body having a longitudinal axis arranged facing said light radiation source for propagating light radiation from said source distally of the light radiation source along said longitudinal axis, the light-permeable body comprising:

a collimator exposed to said light radiation source for collecting light radiation from said light radiation source and injecting it into said light-permeable body, a portion tapered from an input end towards an output end, the input end of said tapered portion coupled to said collimator for receiving light radiation collimated thereby and directing said collimated radiation towards said output end, and a distal portion coupled to the output end of said tapered portion, the device further comprising an output mirror with a shank portion extending in said distal portion and a head portion, said output mirror reflecting light radiation radially from said longitudinal axis and proximally towards said light radiation source, wherein the shank portion extending in the distal portion of said output mirror has a layered dichroic filter structure;

wherein said layered dichroic filter structure includes a first and a second layer, said first layer having a dichroic filtering surface, wherein light radiation is partially reflected from said first surface and partially propagates through said first layer towards said second layer to be reflected from said second layer; and a casing for said lighting device, said casing including at least one light-permeable portion for emitting light radiation from said lighting device.

9. A method of providing a lighting device, the method comprising:

providing an electrically-powered light radiation source, arranging facing said light radiation source a light-permeable body having a longitudinal axis for propagating light radiation from said source distally of the light radiation source along said longitudinal axis, the light-permeable body comprising:

a collimator exposed to said light radiation source for collecting light radiation from said light radiation source and injecting it into said light-permeable body, a portion tapered from an input end towards an output end, the input end of said tapered portion coupled to said collimator for receiving light radiation collimated thereby and directing said collimated radiation towards said output end, and a distal portion coupled to the output end of said tapered portion, providing an output mirror with a shank portion extending in said distal portion and a head portion, said output mirror reflecting light radiation radially from said longitudinal axis and proximally towards said light radiation source;

wherein the shank portion extending in the distal portion of said output mirror has a layered dichroic filter structure;

wherein said layered dichroic filter structure includes a first and a second layer, said first layer having a dichroic filtering surface, wherein light radiation is partially reflected from said first surface and partially propagates through said first layer towards said second layer to be reflected from said second layer.

* * * * *